United States Patent [19]

Trent

[11] Patent Number: 4,918,935

[45] Date of Patent: Apr. 24, 1990

[54] FLUIDIC FLOW CONTROL

[76] Inventor: Warren C. Trent, 1410 Woodlands Dr., Tyler, Tex. 75703

[21] Appl. No.: 322,517

[22] Filed: Mar. 13, 1989

[51] Int. Cl.[5] ..... F25D 17/06

[52] U.S. Cl. ..... 62/93; 62/285

[58] Field of Search ..... 62/93, 285, 288, 289

[56] References Cited

U.S. PATENT DOCUMENTS

| | | | |
|---|---|---|---|
| 2,048,137 | 7/1936 | Palmer | 62/93 |
| 3,232,029 | 2/1966 | Evan, Jr. | 62/93 |
| 3,635,246 | 1/1972 | Glickman | 137/608 |
| 3,725,964 | 4/1973 | Whitsett | 4/197 |
| 3,818,718 | 6/1974 | Freese | 62/93 |
| 4,484,451 | 11/1984 | Darm | 62/93 |

*Primary Examiner*—Ronald C. Capossela

*Attorney, Agent, or Firm*—Crutsinger & Booth

[57] ABSTRACT

A method and apparatus to remove liquid from a chamber (B) of sub-atmospheric pressure in an air conditioning system wherein a liquid removal conduit (28) is connected to communicate with a chamber of sub-atmospheric pressure and with a condensate disposal place. Air at a pressure above ambient pressure, is delivered through an air line (30) into the flow control (10) between the chamber of sub-atmospheric pressure and the condensate disposal place. The flow rate of air into the liquid removal conduit (10) is controlled to permit flow of liquid through the conduit toward the condensate disposal place while preventing flow of gas through the conduit toward the chamber (A) of sub-atmospheric pressure. The flow rate of gas is controlled by a valve (48) in an air line (30) connected to the conduit (28) and by forming a tortuous path 50(*a*), 50(*b*), 50(*c*), and 50(*d*) in the flow control (10) to induce a loss in gas pressure without restricting flow of liquid.

22 Claims, 4 Drawing Sheets

FLUIDIC FLOW CONTROL

TECHNICAL FIELD

This invention relates to a method and apparatus to remove condensate from a chamber of sub-atmospheric pressure in air conditioning systems while preventing ingestion of polluted air and to remove condensate from a pressurized chamber while minimizing loss of conditioned air.

BACKGROUND OF INVENTION

Controlling moisture (or humidity) in air conditioned space is an essential function of air conditioning systems. Systems which use mechanical refrigeration remove moisture from the air in the form of condensate, and discharge it during the cooling operation to some remote disposal place such as french drains, storm sewers, and sanitary sewers. Since the sanitary sewer often provides the most convenient place for disposal, it is frequently used for this purpose. Discharging condensate directly into the sanitary sewer, however, introduces a potential health problem; that is, the ingestion of polluted air from the sewer into the air conditioning system.

Air conditioning contractors generally address the problem of air ingestion by installing a trap in the condensate drain line leading to the sewer. This practice, although it satisfies most building and mechanical codes does not resolve the problem satisfactorily. In fact, experience shows that condensate traps create numerous health and operational problems and offer few benefits.

The nature of these problems is determined by the air pressure levels at which the air conditioning systems operate. In this regard, there are two types of systems. In one system, condensate is discharged from a region of negative air pressure. In the other system, condensate is discharged from a region of positive air pressure.

An air conditioning system that discharges condensate from a region of negative air pressure, through a conventional trap, often experiences the following problems:

(a) During the winter months, when the air conditioning system is operating in the heating mode, condensate traps frequently become dry (unless supplied with water from an independent source) and do not provide a seal against the ingestion of polluted air or gases from sewers or other disposal places.

(b) During the first start-up for summer cooling operation (when the trap is dry), condensate cannot flow to the disposal place until the condensate in the collecting tray reaches the level necessary to overcome the negative air pressure in the system. During this initial start-up, and while the condensate tray is being filled, the trap remains dry and there is no seal. In the absence of a seal, polluted air can enter the air conditioning system. At the same time, this air rushes into the condensate tray often entraining condensate, produces condensate blow-over, and sometimes causes the tray to overflow. Since start-up, with an empty trap, usually occurs only once a year, some of these adverse effects may be tolerated but they cannot be prudently ignored.

(c) During the cooling operation, condensate traps frequently become clogged with algae and other foreign materials which originate or collect in the condensate tray. Such clogging and the resulting overflow of the condensate tray is a common cause of water damage in homes and other buildings. To avoid repeated trap clogging, service personnel frequently remove the condensate trap. Such action, when the trap is in a condensate line leading to a sanitary sewer, not only allows the ingestion of polluted air during both the heating and cooling operations, it violates most mechanical codes. Of course, when condensate lines lead to disposal places where the air is not polluted, the absence of a trap creates no pollution problem. However, many such air conditioning systems cannot operate successfully in the cooling mode without a trap, because the high rate of air ingestion often causes condensate blow-over.

Air conditioning systems that discharge condensate through conventional traps, from a region of positive air pressure, are unduly burdened with an operational problem. In this type of system, condensate traps are of little value. Since the air pressure surrounding the condensate collection tray is never negative, it is not possible for the system to ingest polluted air. Hence, if employed in this type of an air conditioning system, as required by most mechanical codes, the trap creates an operational problem of clogging without offering any benefits.

When homes and other buildings are being constructed to conserve energy by reducing air infiltration, air conditioned spaces are becoming more and more susceptible to unhealthy pollution. In this environment, it is at best imprudent to tolerate the installation and operation of air conditioning systems with conventional traps, which offer only a partial seal against the ingestion of polluted air.

Clearly, there is a need for control apparatus that will allow for proper disposal of condensate, and provide protection against pollution, and which, at the same time, is inexpensive and essentially troublefree.

DESCRIPTION OF DRAWING

Drawings of several embodiments of the invention are annexed hereto so that the invention may be better and more fully understood, in which.

Numeral references are employed to designate like parts throughout the various figures of the drawing.

DESCRIPTION OF PREFERRED EMBODIMENTS

Figure 1:
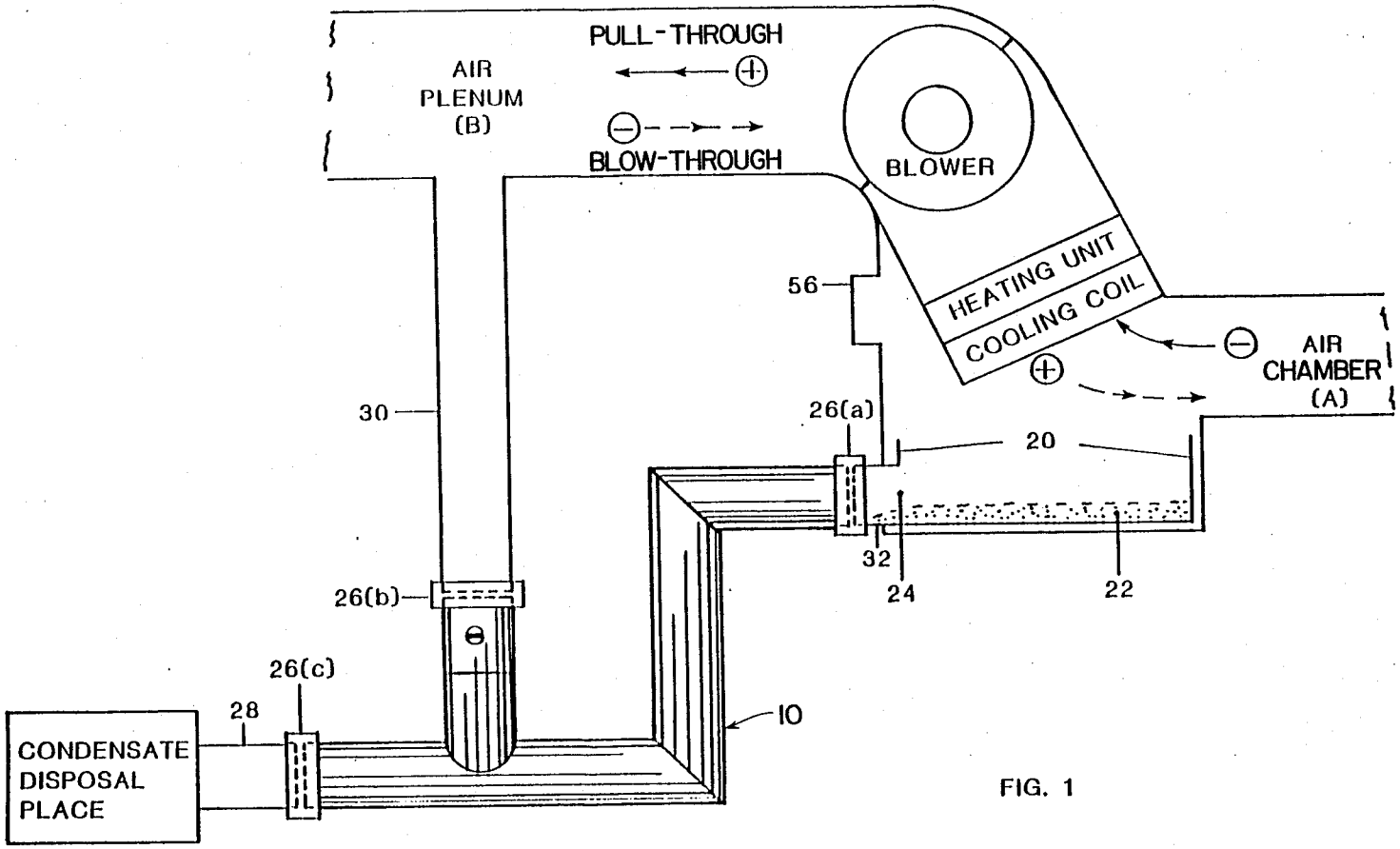
FIG. 1 is a schematic diagram of a typical air conditioning system and illustrates how it interfaces the fluidic flow-control according to the first embodiment of this invention.
Figure 3:
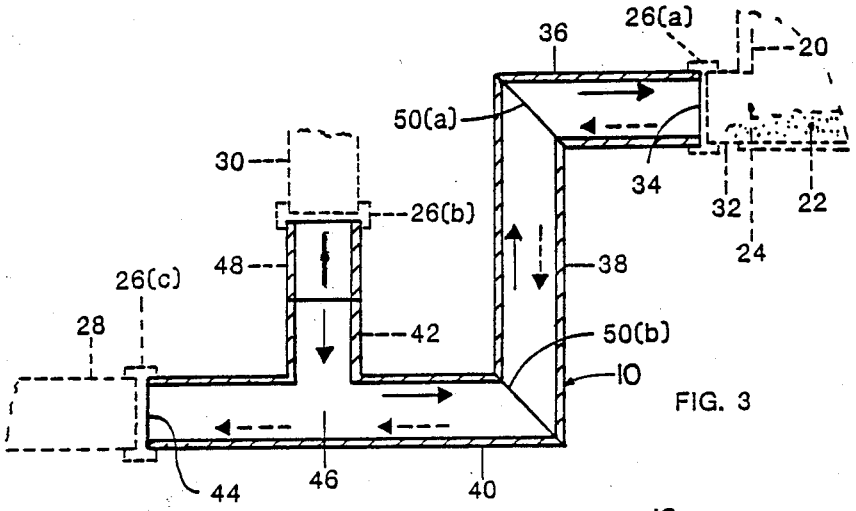
FIG. 3 is a cross-sectional side view taken along line 3—3 of FIG. 2.
Figure 2:
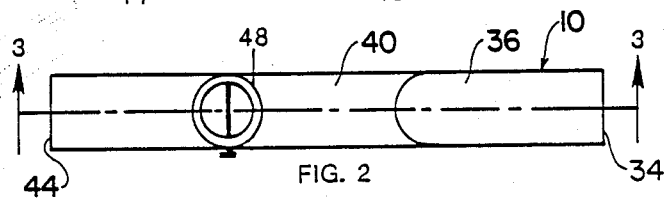
FIG. 2 is a top plan view of the fluidic flow-control device according to the first embodiment of the invention.

A first embodiment of the flow-control is generally designated by the numeral 10 in FIGS. 1–3 of the drawing.

Several embodiments of the invention are illustrated in the drawings. A feature common to the embodiments of the invention includes the provision of one or more 90° mitred elbow or similar high pressure loss fittings 50 in the condensate removal conduit 10 to induce desired losses and drops in air pressure in the condensate removal line.

The way each embodiment of this invention operates depends upon the type of air conditioning system involved and whether the system is operating in the heating or cooling mode. In order to explain the operation of each embodiment it is convenient to show how each embodiment interfaces with the different types of air conditioning systems. FIG. 1 is a schematic of a typical air conditioning system and illustrates how it interfaces with the various embodiments, using the first embodiment (defined in FIGS. 2 and 3) as an example.

The types of air conditioning systems involved are illustrated in FIG. 1. In one type of system, identified as pull-through, the blower pulls air from the air chamber A through the cooling coil and heating unit and discharges it into the air plenum B. The direction of air flow is indicated by double arrows plus solid lines. In the other type system, identified as blow-through, the blower pulls air from the air plenum B and forces it through the heating unit and cooling coil and then into the air chamber A. The direction of airflow through this type system is indicated by double arrows plus dash lines. The encircled symbols—plus and minus—at the tail of each set of arrows and lines indicates the positive and negative pressure level associated with the airflow direction. With respect to this invention, the important difference between the two types of systems is the air pressure developed in the region surrounding the condensate tray 20 and the condensate drain opening 24, see FIG. 1. In the pull-through system this pressure is negative. In the blow-through type system this pressure is positive.

The most important difference between the heating and cooling operations is that during the cooling operation each system accumulates and discharges condensate. No condensate is involved in the heating mode of operation.

FIRST EMBODIMENT

FIGS. 2 and 3 are top and sectional views of the fluidic flow-control 10 according to the first embodiment of the invention. This embodiment comprises four tubular conduits having passages and an airflow adjusting valve. In application, the condensate entrance 34 of a tubular conduit 36 having a passage formed therein, connects to the condensate drain 32 of the air conditioning system by means of connector 26(*a*), as best illustrated in FIG. 3. The other end of tubular conduit 36 connects to tubular conduit 38 having a passage extending therethrough by a 90-degree mitered elbow 50(*a*). At its lower end tubular conduit 38 is connected to a tubular conduit 40 with a 90-degree mitered elbow 50(*b*). The fluid exit 44 of tubular conduit 40 is connected by a connector 26(*c*) to the condensate discharge line 28 that leads to a suitable condensate disposal place. A tubular conduit 42 joins tubular conduit 40 at a 90-degree angle and extends in a direction parallel to tubular conduit 38. An airflow adjusting valve 48, located at the top of tubular conduit 42, is connected to an air line 30 by a connector 26(*b*).

In a pull-through type air conditioning system, air flows through the various passages of the fluidic flow-control 10 as indicated by the arrows plus solid lines in FIG. 3. When operating in the heating mode, air flows from air line 30, through the airflow adjusting valve 48, through the tubular conduit 42, and into tubular conduit 40. Upon entering tubular conduit 40, the airflow divides. A portion of the air passes from tubular conduit 40, through the fluid exit 44, through the condensate discharge line 28, and on into the condensate disposal place. The remainder of the air passes from tubular conduit 40, through tubular conduits 38 and 36 and 90-degree mitered elbows 50(*b*) and 50(*a*), into the negative air pressure region in air chamber A surrounding the condensate drain opening 24.

When airflow through the passages is established and the air pressure in the region of the air ingestion seal 46 is at or above atmospheric, no polluted air can be ingested. The positive air pressure in air line 30 assures an available airflow which exceeds that necessary to provide a seal against ingestion of polluted air from discharge line 28. This excess air passes through the fluid exit 44, through the condensate discharge line 28, and then into the condensate disposal place and is wasted. The airflow adjusting valve 48 provides a means for eliminating or reducing this waste. In practice, setting the airflow adjusting valve 48 is relatively simple. First, the fluidic flow-control is installed as illustrated in FIG. 1, except that the condensate discharge line 28 is not connected at the fluid exit 44. Second, with the air conditioning system operating in the heating mode, the airflow adjusting valve 48 is set for little or no airflow through fluid exit 44. The condition of little or no airflow can be easily determined by applying soap bubbles to the fluid exit 44. Once the adjusting valve is set in this manner and the condensate discharge line 28 connected, the fluidic flow-control 10 will provide an effective seal against ingestion of polluted air, during both heating and cooling operations.

When the airflow adjusting valve 48 is properly set, the gauge air pressure in the region of the air ingestion seal 46 in the passage in tubular conduit 40 is zero (atmospheric) or above, and the ingestion of polluted air is not possible. During operation, air flows continuously from air line 30 through passages in tubular conduits 40, 38 and 36 to the condensate drain opening 24. The airflow required to produce a satisfactory seal is influenced by the pressure loss induced in tubular conduits 38 and 36 and the two 90-degree mitered elbows 50(*b*) and 50(*a*), and depends upon the negative air pressure in air chamber A surrounding the condensate drain opening 24. As the negative air pressure increases, the airflow and velocity of the air entering the condensate tray 20 increase.

In the heating mode of operation, the velocity of the air entering the condensate tray 20 has little significance, but, as will be hereinafter more fully explained, air velocity can become critical during the cooling mode of operation.

During the cooling mode of operation, a pull-through type system experiences two important phases of operation: the start-up phase and the run phase.

At the beginning of the start-up phase, air flows through the fluidic flow-control 10 as it does during the heating operation, since there is no condensate flow. But these conditions change rapidly as condensate accumulates in the condensate tray 20. As the level of the condensate 22 rises and covers the lower area of the condensate drain opening 24, a liquid pressure head is created which tends to cause condensate to flow into the condensate entrance 34 into tubular conduit 36. However, the negative air pressure surrounding the condensate drain opening acts to oppose condensate flow. Accordingly, condensate flow, and the run phase of operation, begins only after condensate rises to a level where the condensate pressure head exceeds the air pressure difference across the condensate drain opening 24. The level of condensate at which flow through the condensate entrance 34 begins depends upon two factors: (1) the air pressure loss induced by air flowing from the region of the air ingestion seal 46 through the 90-degree mitered elbows 50(*b*) and 50(*a*) and through passages in the tubular conduits 38 and 36 leading to the condensate tray 20, and (2) the negative air pressure which the air conditioning system develops in the region of the condensate drain opening 24. Since the air pressure loss characteristics of this embodiment are fixed, the negative air pressure within the air conditioning system establishes both the airflow rate and the condensate level at which condensate begins to flow. These conditions—that is, the airflow rate and the free area of the condensate drain opening 24 (that area not covered by condensate)—determine the velocity of the air entering the condensate tray 20.

The velocity of the entering air is important because it tends to disturb the surface of the condensate. When the negative air pressure is low, the velocity of the air entering the condensate tray 20 may create little or no disturbance. However, when the negative air pressure level and the entering air velocity are correspondingly high, condensate disturbance can reach an unacceptable level. This situation occurs because at high velocities, the air tends to entrain condensate and blow it over the wall of the condensate tray 20 (blow-over).

The air pressure loss characteristics and, therefore, the airflow through this embodiment are such that it can operate satisfactorily in air conditioning systems where the static pressure rise across the blower is nominal. Such air conditioning systems are widely used in commercial applications.

Once condensate flow begins, it passes through the fluidic flow-control as indicated by the arrows plus dash lines in FIG. 3. Upon leaving the condensate tray 20, the condensate flows through the condensate entrance 34, through passages in tubular conduits 36 and 38 and through two 90-degree mitered elbows 50(*a*) and 50(*b*), through the region of the air ingestion seal 46, past the fluid exit 44 and on into the condensate disposal place. At the same time, air continues to flow through the fluidic flow-control 10 as indicated by arrows plus solid lines in FIG. 3.

The counterflow of condensate and air promotes mixing and agitation which sharply increase the air pressure loss between the region of the air ingestion seal 46 and the condensate drain opening 24. This change in air pressure loss influences the airflow through the fluidic flow-control 10. The airflow and, therefore, the velocity of the air entering the condensate tray 20 reduces significantly and disturbance to the condensate surface becomes essentially nil. At the same time, the air pressure in the region of the air ingestion seal 46 becomes slightly positive and a small, but tolerable, quantity of air flows through the fluid exit 44 and on into the condensate disposal place.

Condensate flowing from an air conditioning system often carries with it bits of algae and other foreign materials that originate and/or collect in the condensate tray 20. As condensate flows through the fluidic flow-control 10 these foreign materials tend to collect in or cling to the walls of the passages in the tubular conduits and impede or stop condensate flow. Since this embodiment has no trap to become clogged with foreign materials, the potential for flow blockage is minimal. Moreover, two operational features of the fluidic flow-control 10 practically eliminate the potential for flow blockage. First, the counterflow of air and condensate in the passages of the flow-control 10 produces agitation and purging action which prevents collection and buildup of foreign materials. Second, each time the cooling operation ceases, the small positive pressure head of condensate in the condensate tray causes a flow of condensate which flushes foreign materials from the passages inside the fluidic flow-control. Hence, in this embodiment there is little potential for condensate flow blockage, resulting condensate overflow, and associated water damage.

When used with a blow-through type air conditioning system, the first embodiment of the invention is installed as it is in the pull-through type system, illustrated in FIG. 1. It operates differently, however, because the air pressures in the region of the condensate drain opening 24 in air chamber A and in the air plenum B are such that airflow direction through the fluidic flow-control is reversed. That is, as shown in FIG. 3, the air flows in the direction opposite to that indicated by the arrows plus solid lines. In this type system, where the air pressure in the region of the condensate drain opening 24 is always positive, there is no danger of ingesting polluted air from the sanitary sewer (or condensate disposal place). The concern is that air flowing from the region of the condensate drain opening 24 could overload the vent system of the sanitary sewer and prevent it from operating properly.

When operating in the a blow-through type air conditioning system, as illustrated in FIG. 3, air flows from the region of the condensate drain opening 24 into the fluidic flow-control 10 through condensate entrance 34. From there, air passes through two 90-degree mitered elbows 50(*a*) and 50(*b*) and tubular conduits 36 and 38 and then enters tubular conduit 40. In tubular conduit 40, the air divides. A portion of the air enters tubular conduit 42, passes through the airflow adjusting valve 48 and then enters the air line 30 leading to air plenum B, as illustrated in FIGS. 1 and 3. The remaining portion of the air entering tubular conduit 40 flows through fluid exit 44, through the condensate discharge line 28, and on into the sanitary sewer (or condensate disposal place). The quantity of air passing to the vent system of the sanitary sewer depends upon the air pressure in the region surrounding the condensate drain opening 24 and the setting of airflow adjusting valve 48. Setting the airflow adjusting valve 48 to minimize airflow to the sewer vent system is quite simple. First, the fluidic flow-control 10 is installed as illustrated in FIGS. 1 and 3, except that the condensate discharge line 28 is not connected at the fluid exit 44. Second, with the air conditioning system operating in the heating mode, the airflow adjusting valve 48 is set for little or no airflow through fluid exit 44. The condition of little or no airflow can be easily determined by applying soap bubbles to the fluid exit 44. Once the airflow adjusting valve 48 is set in this manner and the condensate discharge line 28 is connected, the fluidic flow-control will prevent the ingestion of polluted air and minimize the air flowing into the sanitary vent system, during both heating and cooling operations.

In the blow-through type air conditioning system, operation of the fluidic flow-control is quite similar in the hating and cooling modes. The only difference is that, during the cooling mode of operation, both air and condensate flow through the fluidic flow-control. The arrows plus dash lines in FIG. 3 show the direction of condensate flow, while air flows in a direction opposite to that indicated by the arrows plus solid lines. The combined flow of air and condensate affect operation of the fluidic flow-control in two ways. One, condensate flowing through the passages reduces the area available for airflow, but this has no adverse influence on the performance of the fluidic flow-control 10. Two, airflow through the fluidic flow-control tends to purge the passages of foreign materials carried by the condensate, and reduces the potential for condensate flow blockage, the resulting condensate overflow, and the associated water damage.

SECOND EMBODIMENT

Figure 5:
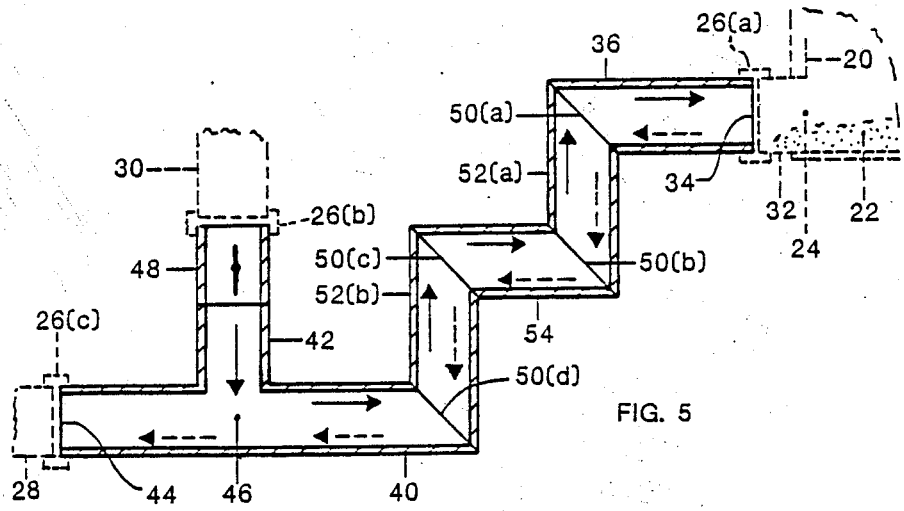
FIG. 5 is a cross-sectional side view taken along line 5—5 of FIG. 4.
Figure 4:
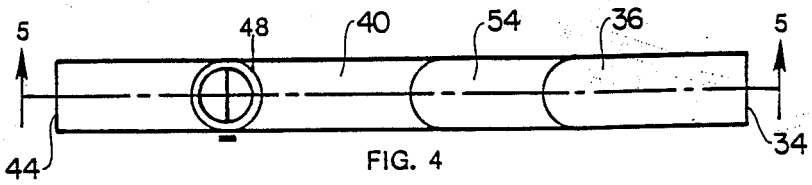
FIG. 4 is a top plan view of the fluidic flow-control according to the second embodiment of the invention.

FIGS. 4 and 5 show top and sectional side views of the fluidic flow-control according to the second embodiment of the invention. This embodiment is comprised of six tubular conduits and an airflow adjusting valve 48. When installed, the condensate entrance 34 of tubular conduit 36 is connect by a connector 26(*a*) to the condensate drain 32 of the air conditioning system. The other end of tubular conduit 36 connects to a tubular conduit 52(*a*), by a 90-degree mitered elbow 50(*a*). The lower end of tubular conduit 52(*a*) is connected through a 90-degree mitered elbow 50(*b*) to a tubular conduit 54. The left end of tubular conduit 54, as viewed in FIG. 5, joins tubular conduit 52(*b*) with a 90-degree mitered elbow 50(*c*). Tubular conduit 52(*b*) connects to the right end of the tubular conduit 40 through a 90-degree mitered elbow 50(*d*). The fluid exit 44 of the tubular conduit 40 connects through connector 26(*c*) to the condensate discharge line 28 that leads to the condensate disposal place. Tubular conduit 42 joins tubular conduit 40 at a 90-degree angle and extends in a direction parallel to tubular conduit 52(*a*) and 52(*b*). The airflow adjusting valve 48 located at the top of tubular conduit 42 is connected to air line 30 by connector 26(*b*).

The second embodiment of this invention, shown schematically in FIG. 5, is similar to and operates like the first embodiment. It connects to the air conditioning system in exactly the same way as does the first embodiment, illustrated in FIG. 1. This embodiment differs from the first embodiment geometrically in that it includes four 90-degree mitered elbows instead of two such elbows, see FIG. 5. The effect of the two added elbows 50(*c*) and 50(*d*) is to increase the resistance to airflow, which during operation reduces the airflow through the various passages.

When used with pull-through type air conditioning systems, air and condensate flow through the passages of this embodiment as indicated in FIG. 5, by arrows plus solid lines and arrows plus dash lines, respectively.

In order to provide an effective seal against the ingestion of polluted air, the airflow adjusting valve 48 is set using the same procedures described for adjusting the first embodiment. When adjusted in this manner, the second embodiment, illustrated in FIGS. 4 and 5, provides the same protection against the ingestion of polluted air as does the first embodiment. However, there are differences. These differences are small when the embodiments are used with a pull-through type air conditioning system operating in the heating mode. However, the reduced air-flow and higher air pressures losses associated with the second embodiment have a significant and desirable influence on how the air conditioning system operates in the cooling mode. The higher air pressure loss induced by air flowing through tubular conduits 52(*b*), 54, 52(*a*) and 36 and through the 90-degree mitered elbows 50(*d*), 50(*c*), 50(*b*) and 50(*a*) results in a reduced air pressure differential across the condensate drain opening 24. As explained in the description of the first embodiment, a reduction in this air pressure differential reduces the level of condensate required in the condensate tray 20 to initiate condensate flow. At the lower condensate level, the free area left for airflow through the condensate drain opening 24 is increased. The greater free area and the reduced airflow, associated with the second embodiment, results in a reduction in the velocity of the air entering the condensate tray 20.

Since, as explained for the first embodiment, the velocity of the air entering the condensate tray 20 limits the negative air pressure level at which a pull-through type of air conditioning system can operate successfully, it follows that the second embodiment can accommodate a greater negative air pressure level than can the first embodiment. In particular, this embodiment can operate successfully in air conditioning systems where the static pressure rise across the blower, see FIG. 1, is higher than nominal. It is suitable for use with a majority of all pull-through type air conditioning systems.

Once condensate flow starts and the run phase begins, both air and condensate flow through the passages as described for the first embodiment, and indicated by arrows plus dash lines in FIG. 5. The only difference in operation of the two embodiments, during the run phase, is that this second embodiment allows slightly more air to pass through fluid exit 44 to the condensate disposal place than does the first embodiment.

As with the first embodiment, the agitation created by the counterflow of air and condensate passing through this embodiment tends to purge foreign materials from passages. And the flushing action of the condensate that occurs when the cooling operation ceases essentially nullifies the potential for flow blockage, the resulting condensate overflow, and the associated water damage.

The second embodiment, like the first embodiment, may be used successfully in a blow-through type air conditioning system; that is, it is applicable to systems where the air pressure in the region surrounding the condensate drain opening 24 in air chamber A is positive and the air pressure in the air line 30 communicating with air plenum B is negative. In this type of system, the second embodiment operates the same as explained for the first embodiment. The only difference is that, because of the two added 90-degree mitered elbows, the air circulated through the passages and the airflow adjusting valve 48 during operation is less that it is for the first embodiment.

THIRD EMBODIMENT

Figure 7:
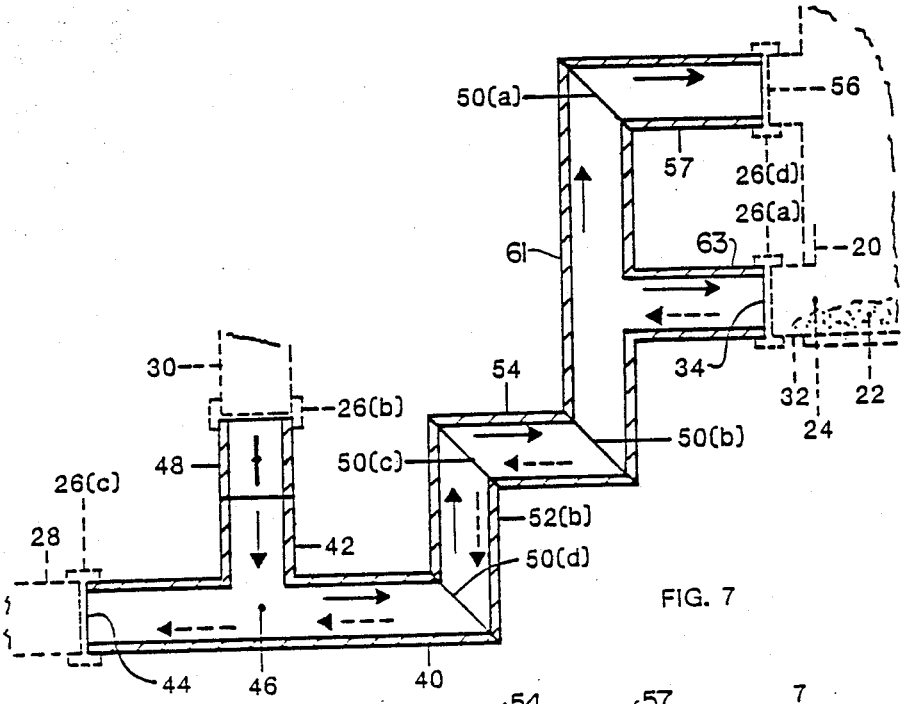
FIG. 7 is a cross-sectional side view taken along line 7—7 of FIG. 6.
Figure 6:
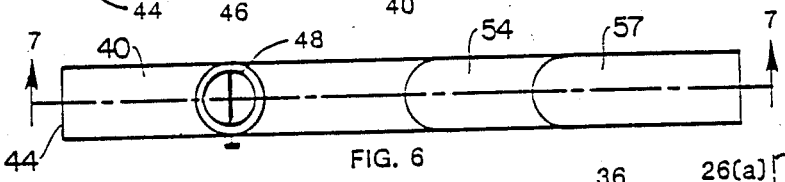
FIG. 6 is a top plan view of the fluidic flow-control according to the third embodiment of the invention.

FIGS. 6 and 7 show top and sectional side views of the fluidic flow-control according to the third embodiment of the inventions. This embodiment is comprised of seven tubular conduits having passages and an airflow adjusting valve. Tubular conduit 57 is connected by connector 26(*d*) to an ancillary connection 56 (see FIGS. 1 and 7) at a suitable distance above the condensate tray 20, in a region where the air pressure is the same as that at the condensate drain opening. The left end of tubular conduit 57 joins tubular conduit 61 with a 90-degree mitered elbow 50(*a*). The condensate entrance 34 of tubular conduit 60 is connected by connector 26(*a*) to the condensate drain 32 of the air conditioning system. Tubular conduit 60 then runs parallel to tubular conduit 57 and joins tubular conduit 61 at a 90-degree angle. Tubular conduit 61 joins tubular conduit 54 at its right end with a 90-degree mitered elbow 50(*b*). The left end of tubular conduit 54 connects to the upper end of tubular conduit 52(*b*) with a 90-degree mitered elbow 50(*c*). The lower end of tubular conduit 52(*b*) joins tubular conduit 40 with a 90-degree mitered elbow 50(*d*) at its right end. The fluid exit 44 of tubular conduit 40 is connected by means of connector 26(*c*) to the condensate discharge line 28 that leads to the condensate disposal place. Tubular conduit 42 joins tubular conduit 40 at a 90-degree angle and extends in a direction parallel to tubular conduits 52(*b*) and 61. The airflow adjusting valve 48 located at the top of tubular conduit 42 connects to air line 30 by means of connector 26(*b*).

The third embodiment of this invention, shown schematically in FIG. 7, makes use of the same principles as does the first and second embodiments. It differs from the second embodiment in that tubular conduits 57, 60, and 61 replace tubular conduits 36 and 52(*a*), see FIGS. 5 and 7. This embodiment connects to the air conditioning system much like the first embodiment does. The difference is that tubular conduit 57 connects to ancillary connection 56, identified in FIG. 1. The ancillary connection 56 is located a few inches above the condensate tray 20 and enters a region where the air pressure is the same as that surrounding the condensate drain opening 24. In operation, this embodiment performs much like the second embodiment and it effects a seal against polluted air ingestion in precisely the same way. When used with pull-through type air conditioning systems, air and condensate flow through the passages of this embodiment as indicated in FIG. 7, by arrows plus solid lines and arrows plus dash lines, respectively.

The adjustment necessary to effect a seal against air ingestion is performed exactly as described for the first embodiment. The airflow conditions that produce the seal, however, are quite different. When the system operates in the heating mode, the air flowing through the region of the air ingestion seal 46 is somewhat greater than it would be if the second embodiment were used. But this difference has no significant influence on the performance of the air conditioning system. The important difference between these two embodiments arises when the system is operated in the cooling mode. This difference is a result of the added airflow path provided by the inclusion of the tubular conduits 57 and 61, see FIG. 7. In this embodiment, air flowing from the region of the air ingestion seal 46 through the condensate entrance 34 experiences about the same resistance to air flow as it would in the second embodiment. However, because of the increased area provided for airflow in the tubular conduits 57 and 61, of this embodiment, the total airflow between the region of the air ingestion seal 46 and the region surrounding the condensate drain opening 34 is much higher than in the first or second embodiment. This higher airflow increases the air pressure loss across the 90-degree mitered elbows 50(*d*), 50(*c*) and 50(*b*), thereby reducing the pressure differential developed across the condensate drain opening 24. As explained hereinbefore, a reduction in this pressure differential reduces the level of condensate required in the condensate tray 20 to initiate condensate flow. At the lower condensate level, the open area available for air to flow through the condensate drain opening 24 is greater than that available with the second embodiment. In addition, tubular conduit 57 connected to ancillary connection 56 provides a second path for airflow, see FIGS. 1 and 7. As a result the velocity of the air entering directly into the condensate tray 20 is much less for this embodiment than for the first and second embodiments. As explained for the first embodiment, the velocity of the air entering the condensate tray 20 limits the negative air pressure level at which a pull-through type of air conditioning system can operate successfully. Hence, it follows that this third embodiment can accommodate a greater negative air pressure level than can either the first or second embodiment. More specifically, this embodiment can operate successfully in air conditioning systems where the static pressure rise across the blower, see FIG. 1, is very much higher than nominal. With a few possible exceptions, this embodiment is suitable for use in air conditioning systems where the static pressure rise across the blower is any practical value.

Once condensate flow starts and the run phase begins, both air and condensate flow through the passages as described for the second embodiment, and as indicated by arrows plus dash lines in FIG. 7. The only difference in operation of the two embodiments, during the run phase of the cooling mode, is that this third embodiment, illustrated in FIGS. 6 and 7, allows slightly less air to pass to the condensate disposal place, than does the second embodiment, illustrated in FIGS. 4 and 5.

As with the first and second embodiment, the agitation created by the counterflow of air and condensate passing through this embodiment tends to purge foreign materials from it passages, and the flushing action of the condensate that occurs when the cooling operation ceases essentially nullifies the potential for flow blockage, the resulting condensate overflow, and the associated water damage.

FOURTH EMBODIMENT

Figure 9:
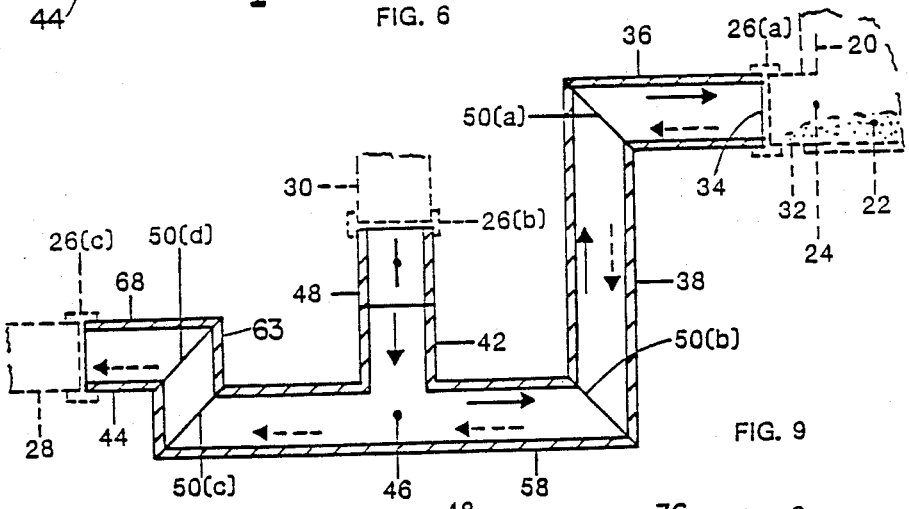
FIG. 9 is a cross-sectional side view taken along line 9—9 of FIG. 8.
Figure 8:
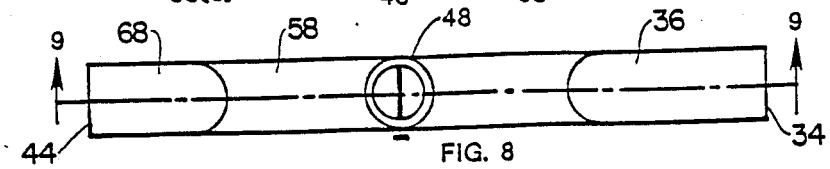
FIG. 8 is a top plan view of the fluidic flow-control according to the fourth embodiment of the invention.

FIGS. 8 and 9 are top plan and cross-sectional views of the fluidic flow-control according to the fourth embodiment of the invention. This embodiment consists of six tubular conduits having internal passages and an airflow adjusting valve. In application, the condensate entrance 34 of tubular conduit 36 connects by means of connector 26(*a*) to the condensate drain 32 of the air conditioning system, see FIG. 9. The other end of the passage through tubular conduit 36 connects to tubular conduit 38 by means of a 90-degree mitered elbow 50(*a*). At its lower end, passage 38 joins tubular conduit 58 at a degree angle with a mitered elbow 50(*b*). The left end of tubular conduit 58 joins tubular conduit 63 with a 90-degree mitered elbow 50(*c*). Tubular conduit 68 connects to tubular conduit 63 with a 90 degree mitered elbow 50(*d*), and runs parallel to tubular conduits 36 and 58. The fluid exit 44 of tubular conduit 68 connects by means of connector 26(*c*) to the condensate discharge line 28 that leads to the condensate disposal place. Tubular conduit 42 joins tubular conduit 58 at a 90-degree angle and extends in a direction parallel to tubular conduit 38 and 63. The airflow adjusting valve 48 located at the top of tubular conduit 42 connects to air line 30 by means of connector 26(*b*). The fourth embodiment of this invention, schematically illustrated in FIG. 9, is similar to the first embodiment, except it incorporates a shallow condensate trap. Geometrically, it differs from the first embodiment in that tubular conduit 40 (FIG. 3) is replaced with tubular conduits 58, 63, and 68 (FIG. 9). This embodiment connects to the air conditioning system in exactly the same way as does the first embodiment, as illustrated in FIGS. 1–3.

When used with pull-through type air conditioning systems, air and condensate flow through the passages of this embodiment as indicated in FIG. 9, by arrows plus solid lines and arrows plus dash lines, respectively.

In order to provide a seal against the ingestion of polluted air, the airflow adjusting valve 48 is set using the same procedures described for adjusting the first embodiment. When adjusted in this manner, the fourth embodiment provides the same protection against the ingestion of polluted air as does the first embodiment. And the volume of air that flows through air adjusting valve 48 and into the condensate tray 20, during the heating mode and the start-up phase of the cooling mode, is the same for both embodiments. However, once condensate starts to flow, and the run phase begins, there is a major difference between the performance of these two embodiments. Upon leaving the condensate tray 20, the condensate flows through the condensate entrance 34, through tubular conduits 36 and 38 and fills the tubular conduit 58. The condensate then rises through the tubular conduit 63 and flows into the tubular conduit 68. From there the condensate flows through the fluid exit 44 and passes through the condensate discharge line 28 to the condensate disposal place.

When filled with condensate, the trap formed by conduits 63, 58 and 36 essentially stops airflow into the condensate tray 20, and eliminates disturbance of the condensate surface. But the most important feature of the shallow trap, included in the fourth embodiment illustrated in FIGS. 8 and 9, is the improved operation it offers during start-up operations that follow the initial start-up of the air conditioning system. Unlike the first embodiment, the fourth embodiment, with a shallow trap, retains condensate within its passages for an extended period of time after the air conditioning cycles to the off condition. Generally, the time period between on and off operation of the air conditioning system is such that some condensate will remain in the shallow trap at all times. When start-up is initiated with condensate in the trap, mixing and agitation between the air and condensate introduces pressure losses that minimizes airflow into the condensate tray 20. Hence, except for the initial start-up of the air conditioning system, at the beginning of the cooling season, this fourth embodiment, with minimized airflow, essentially eliminates the potential for condensate blow-over during the start-up phase.

This embodiment like the first embodiment of the invention can operate in air conditioning systems where the static pressure rise across the blower, see FIG. 1, is nominal. However, under circumstances where it is practical to fill the condensate trap with water, manually or otherwise, prior to the initial start-up for the cooling operation, this embodiment is suitable for use in a majority of all air conditioning system, the same as the second embodiment.

Once the condensate trap is filled, airflow through the various passages of the embodiment becomes negligible. The fourth embodiment, like the first and second embodiments, may be used successfully in a blow-through type air conditioning system.

The principal disadvantage of this embodiment is that the condensate trap formed by conduits 63, 58 and 38 tends to collect foreign materials that block condensate flow, induce overflow, and cause water damage. The mixing and agitation resulting from the combined flow of air and condensate in the tubular conduits 58, 38, and 36 tend to purge foreign materials from the passages.

FIFTH EMBODIMENT

Figure 11:
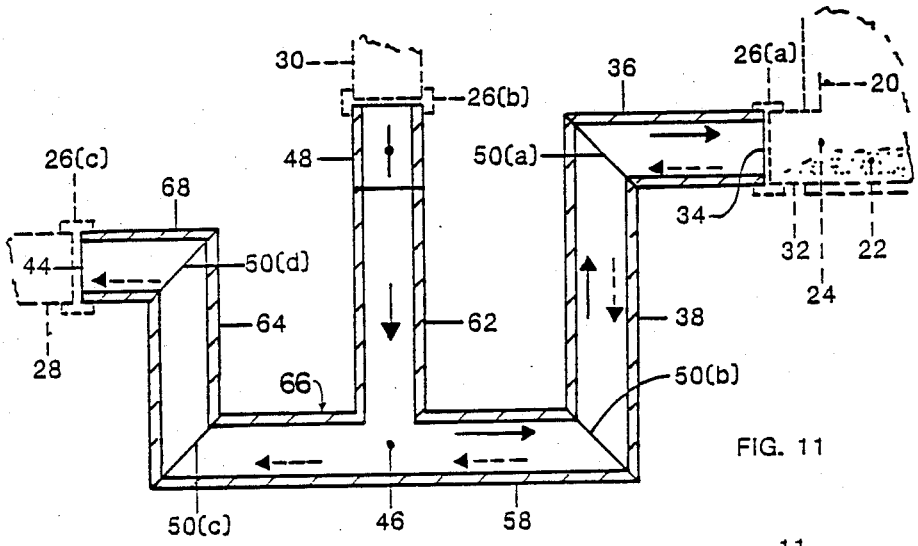
FIG. 11 is a cross-sectional taken along line 11—11 of FIG. 10.
Figure 10:
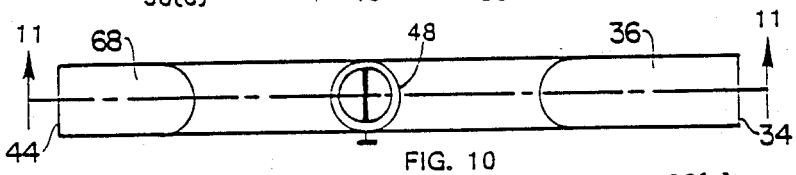
FIG. 10 is a top plan view of the fluidic flow-control according to the fifth embodiment of the invention.

FIGS. 10 and 11 show top and sectional side views of the fluidic flow-control according to the fifth embodiment of the invention. This embodiment consists of five tubular conduits having internal passages and an airflow adjusting valve. In application, the condensate entrance 34 of tubular conduit 36 connects by means of connector 26(*a*) to the condensate drain 32 of the air conditioning system, see FIG. 11. The other end of tubular conduit 36 connects to tubular conduit 38 by means of a 90-degree mitered elbow 50(*a*). At its lower end, tubular conduit 38 joins tubular conduit 58 at a 90-degree angle with a mitered elbow 50(*b*). The left end of tubular conduit 58 joins tubular conduit 64 with a 90-degree mitered elbow 50(*c*). Tubular conduit 68 connects to tubular conduit 64 with a 90-degree mitered elbow 50(*d*) and runs parallel to passages extending through conduits 36 and 58. The fluid exit 44 of tubular conduit 68 connects by means of connector 26(*c*) to the condensate discharge line 28 that leads to the condensate disposal place. The tubular passage through conduit 62 joins the passage through conduit 58 at a 90-degree angle and extends in a direction parallel to passages through tubular conduits 38 and 64. The airflow adjusting valve 48 located at the top of tubular conduit 62 connects to air line 30 by means of connector 26(*b*).

The fifth embodiment of this invention, shown schematically in FIG. 11, is similar to the fourth embodiment (FIG. 9). It connects to the air conditioning system like the other embodiments. It differs from the fourth embodiment in that tubular conduit 64 replaces tubular conduit 63 (FIG. 9) and tubular conduit 62 replaces tubular conduit 42 (FIG. 9). Tubular conduit 64 gives added depth to the condensate trap 66 formed by conduits 64, 58, and 38. Tubular conduit 62, by its increased length, raises the airflow adjusting valve 48 above the level of the condensate, when the trap is full.

The fifth embodiment illustrated in FIGS. 10 and 11, which incorporates tubular conduit 62 and airflow adjusting valve 48, makes it possible for the trap 66 formed by conduits 64, 58 and 38 to effect a seal against the ingestion of polluted air by the pullthrough type air conditioning systems, while operating in the heating mode (dry trap).

When used with pull-through type air conditioning systems, air and condensate flow through the passages of this embodiment as indicated in FIG. 11, by arrows plus solid lines and arrows plus dash lines, respectively.

In order to provide a seal against the ingestion of polluted air, the airflow adjusting valve 48 is set using the same procedures described for adjusting the first embodiment. When adjusted in this manner, the fifth embodiment provides the same protection against the ingestion of polluted air as does the first embodiment. And the volume of air that flows through air adjusting valve 48 and into the condensate tray 20, during the heating mode and the start-up mode of the cooling mode, is essentially the same as for the first embodiment. However, once condensate flow, and the run phase, begins there is a major difference between the operation of this and the first embodiment. Upon leaving the condensate tray 20, the condensate flows through the condensate entrance 34, through tubular conduits 36 and 38 and fills the passage in tubular conduit 58. It then rises through the tubular conduit 64 and flows into the tubular conduit 68. From there the condensate flows through the fluid exit 44 and passes through the condensate discharge line 28 to the condensate disposal place.

When filled with condensate, the trap 66 formed by conduits 64, 58, and 38 prevents air from flowing into the condensate tray 20, and eliminates disturbance of the condensate surface. But the most important feature of the condensate trap included in the fifth embodiment, is the improved operation it offers during start-up operations that follow the initial start-up of the air conditioning system. Like the fourth embodiment, the trap retains condensate within its passages after the air conditioning cycles to the off condition. Since the condensate trap 66 formed by conduits 64, 58 and 38 is deep it will retain several inches of condensate over a very long period of time. Hence, once filled with condensate, this embodiment can eliminate the possibility of condensate blow-over, except during the initial startup of the air conditioning system—at the beginning of the cooling season.

This embodiment of the invention, like the fourth embodiment can operate in air conditioning systems where the static pressure rise across the blower, see FIG. 1, is nominal. However, under circumstances where it is practical to fill the condensate trap with water, manually or otherwise, prior to the initial start-up for the cooling operation, this embodiment is suitable for use in air conditioning systems where the static pressure rise across the blower is any practical value.

Once the condensate trap if filled with water, no air can flow through the passages of this embodiment.

The fifth embodiment, like the first and second embodiments, may be used successfully in a blow-through type air conditioning system.

SIXTH EMBODIMENT

Figure 13:
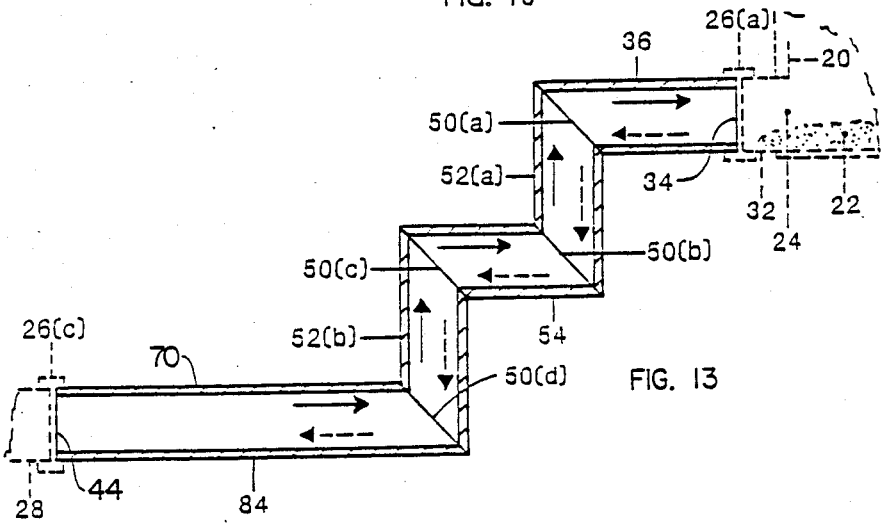
FIG. 13 is a cross-sectional view taken along line 13—13 of FIG. 12.
Figure 12:
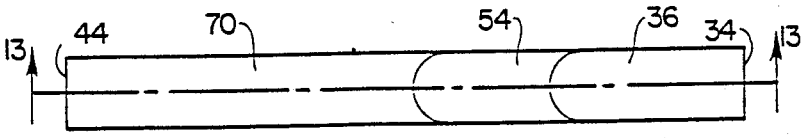
FIG. 12 is a top plan view of the fluidic flow-control according to the sixth embodiment of the invention.

FIGS. 12 and 13 show top plan and sectional side views of the fluidic flow-control according to the seventh embodiment of the invention. This embodiment consists of five tubular conduits having passages. When installed, the condensate entrance 34 of tubular conduit 36 connects by means of connector 26(*a*) to the condensate drain 32 of the air conditioning system, see FIG. 13. The other end of tubular conduit 36 connects to tubular conduit 52(*a*), by means of a 90-degree mitered elbow 50(*a*). The lower of end of tubular conduit 52(*a*) is connected through a 90-degree mitered elbow 50(*b*) to tubular conduit 54. The left end of tubular conduit 54 joins tubular conduit 52(*b*) with a 90-degree mitered elbow 50(*c*). Tubular conduit 52(*b*) connects to the right end of the tubular conduit 70 through a 90-degree mitered elbow 50(*d*). The fluid exit 44 of the tubular conduit having a passage 70 connects by means of connector 26(*c*) to the condensate discharge line 28 that leads to the condensate disposal place.

The sixth embodiment of this invention, shown schematically in FIG. 13, is similar to the second embodiment (FIG. 5), except that tubular conduits 40 and 42 and airflow adjusting valve 48 are replaced with tubular conduit 70. So modified, this embodiment cannot be adjusted to prevent air ingestion from nor to limit airflow to the condensate disposal place. Its simplicity, however, makes it desirable for special applications.

When used with pull-through type air conditioning systems, air and condensate flow through the passages of this embodiment as indicated in FIG. 13, by arrows plus solid lines and arrows plus dash lines, respectively.

The pressure loss incurred by air flowing through the passages and elbows 50(*a*), 50(*b*), 50(*c*) and 50(*d*) of this embodiment are comparable to those pressure losses incurred in the second embodiment. Accordingly, this embodiment can operate satisfactorily in air conditioning system where the static pressure rise across the blower (or fan) is much higher than nominal, the same as for the second embodiment.

This sixth embodiment is also applicable to blow-through type air conditioning systems. In such applications, condensate and air flow in the same direction, as indicated by the arrows and dash lines in FIG. 13. That is, air flows from the region of the condensate tray 20 to the condensate disposal place under all operating conditions. The high pressure loss induced by air flowing through the various passages and elbows, however, tend to minimize the quantity of airflow. In those instances where a small quantity of air can enter the condensate disposal place without adverse effects, this embodiment may be a desirable choice.

From the foregoing it should be readily apparent that the various embodiments provide flow-control, which will prevent air conditioning systems from ingesting polluted air from the sanitary sewer, or from other condensate disposal places, to prevent the pollution of air in conditioned and inhabited spaces.

The structures eliminate the necessity of condensate traps in air conditioning systems, and thereby eliminate the maintenance expense and other cost associated with frequent trap blockages and the property damage that results from condensate blow-over and overflow. However, the structures may be used in combination with traps, if necessary to comply with building codes.

In addition, the embodiments provide a means for minimizing the amount of air that certain types of air conditioning systems discharge into the sanitary sewer; thus, reducing the possibility of overloading the sewer vent system.

The structure provides an inexpensive flow-control that can be installed in either existing or new air conditioning systems to protect against condensate blow-over and to prevent the ingestion of polluted air from any condensate disposal place.

Specially designed fluid flow passages, which restrict the flow of air, without adversely affecting the flow of condensate, simply control the amount of air ingested by the air conditioning system and prevent condensate blow-over.

The positive and negative air pressure levels present in air conditioning systems are utilized, in conjunction with the specially designed air and condensate passages, in such a manner that condensate can be discharged at or above atmospheric pressure. In this way, the fluidic flow-control, according to this invention, assures a positive seal against ingestion of polluted air by the air conditioning system during all operating conditions.

The turbulence created by the parallel-flow and the counterflow of air and water through the flow passages purge them of foreign matter; thus, reducing the possibility of condensate flow blockage. In addition, each time the cooling operation ceases the small positive pressure head of condensate in the condensate tray causes a flow that flushes foreign material from the flow passages in the fluidic flow-control.

In those applications where air conditioning systems dispose of condensate in an unpolluted place, there is of course no need to provide a seal against air ingestion. In such cases, the fluidic flow-control can be used in greatly simplified form. Only the specially designed passages are needed to restrict airflow and prevent condensate blow-over.

Through the use of a valve 48, or other control devices, properly placed for adjusting airflow, the fluidic flow-control, is adaptable to and can be used successfully with air conditioning systems that operate over a wide range of air pressure levels. If it is deemed expedient to do so, valve 48 may be replaced by a fixed orifice flow control device (not shown) or a conduit 30 may be selected having a flow passage sized to provide a predetermined flow of air under specified operating conditions.

Once installed and adjusted, the fluidic flow-control effects proper control of fluid flow automatically, during all modes of operation. The fluidic flow-control is simple, effective, compact and, does not require moving parts for successful operation. Hence, it can be used with existing or new air conditioning installations to provide protection against the ingestion of polluted air or gases, for very little cost.

Having described my invention, I claim:

1. A method of removing liquid from an air chamber comprising the steps of: providing a liquid removal conduit communicating with the air chamber and with a source of gas; delivering air into said liquid removal conduit between said air chamber and said source of gas; and controlling the flow rate of air into said liquid removal conduit to permit flow of liquid through the conduit toward the source of gas while preventing flow of gas through the conduit toward the air chamber.

2. The method of claim 1, the step of delivering air into said liquid removal conduit comprising the steps of: connecting an air line to communicate with a pressurized plenum and with the liquid removal conduit.

3. The method of claim 2, the step of controlling the flow rate of air comprising the steps of: controlling the flow rate of air from the pressurized plenum through the air line into the liquid removal conduit.

4. The method of claim 3, the step of controlling the flow rate of air from the pressurized plenum through the air line comprising the step of: adjusting a control valve to control the flow of air through the air line.

5. The method of claim 3, the step of controlling the flow rate of air from the pressurized plenum through the air line comprising the step of: selecting a control orifice to control the flow of air through the air line.

6. The method of claim 3, the step of controlling the flow rate of air from the pressurized plenum through the air line comprising the step of: forming the air line from a conduit having a flow passage to control the flow of air through the air line.

7. The method of claim 1, the step of controlling the flow rate of air to permit flow of liquid through the conduit toward the source of gas comprising the steps of: controlling the flow rate of gas in said liquid removal conduit.

8. The method of claim 7, the step of controlling the flow rate of gas in said liquid removal conduit toward said chamber comprising the steps of: causing gas in the liquid removal conduit to flow along a circuitous route.

9. The method of claim 1, the step of controlling the flow rate of air through said liquid removal conduit comprising the step of inducing a loss of pressure in gas flowing through said conduit toward the chamber.

10. The method of claim 9, wherein the chamber is at sub-atmospheric pressure and the step of inducing a pressure loss comprises the step of: directing flow of air along a tortuous path through said liquid removal conduit.

11. The method of claim 9, wherein the chamber is pressurized and the step of inducing a pressure loss comprises the step of: directing flow of air along a tortuous path through said liquid removal conduit from the chamber.

12. An air conditioning system comprising: an air plenum; a chamber; a heat exchanger in said chamber; a blower to move air from the chamber into the air plenum such that air pressure in said air plenum exceeds air pressure in said chamber; a condensate tray in said plenum positioned to collect condensate, said condensate tray and said plenum having a condensate discharge opening; a condensate removal conduit having first and second ends, said first end of said condensate removal conduit communicating with said discharge opening; elbow in said condensate removal conduit configured to induce an air pressure drop between said first and second ends of said condensate removal conduit; an air line communicating with said air plenum and said condensate removal conduit; and flow control means regulating air flow through said air line to maintain air pressure in conduit sufficient to prevent exhausting of air from the second end of said condensate removal conduit.

13. An air conditioning system comprising: an air plenum; a chamber; a heat exchanger in said chamber; a blower to move air from the chamber into the air plenum such that air pressure in said air plenum exceeds air pressure in said chamber; a condensate tray in said chamber positioned to collect condensate, said condensate tray and said chamber having a condensate discharge opening; a condensate removal conduit having first and second ends, said first end of said condensate removal conduit communicating with said discharge opening; elbow means in said condensate removal conduit configured to induce an air pressure drop between said first and second ends of said condensate removal conduit; an air line communicating with said air plenum and said condensate removal conduit; and flow control means regulating air flow through said air line to maintain air pressure at said discharge opening sufficient to prevent ingestion of air from the second end of said condensate removal conduit toward said discharge opening.

14. An air conditioning system according to claim 13, said flow control means comprising a valve.

15. A fluidic flow control having a passageway through which liquid flows from a region of low gas pressure into a region of high gas pressure to produce a seal which prevents gas in the region of high gas pressure from flowing into the region of low gas pressure comprising: a conduit having a flow passage extending therethrough, said flow passage being configured to permit gravity flow of liquid therethrough; inlet means connectable to deliver liquid from the region of low gas pressure into the passage in the conduit; a source of pressurized gas; means delivering pressurized gas into said conduit, said pressurized means being adapted to deliver a sufficient volume of gas into said passage in said conduit to pressurize the condensate removal conduit and prevent ingestion of gas from the region of high gas pressure into the region of low gas pressure.

16. The fluidic flow-control of claim 15, said conduit being constructed and arranged to retain a small quantity of liquid so that the liquid retained will mix with pressurized gas flowing toward the region of low gas pressure and induce pressure losses.

17. The fluidic flow-control of claim 15 wherein a portion of said flow passage is arranged to form a liquid trap to retain liquid and thereby effect a seal against the flow of gas from the region of high pressure to the region of low gas pressure.

18. A fluidic flow control having a passageway through which liquid flows under the force of gravity from a condensate tray in a region of low gas pressure to a region of higher gas pressure, which limits the velocity of gas flowing from the region of higher gas pressure to the condensate tray in the region of low gas pressure to prevent condensate in the tray from being blown out of the tray comprising: a conduit having a circuitous flow passage, sections of said circuitous passage being connected at selected angles and having inlet and outlet openings; means for connecting said inlet opening to the region of low gas pressure; means connecting said outlet opening to the region of higher gas pressure such that gas flowing into said circuitous passage from the region of higher gas pressure flows through said circuitous passage in a direction opposite to the direction of flow of liquid therethrough, said circuitous passage being constructed to maintain the velocity of gas sufficiently low to prevent condensate being blown out of the tray in the region of low gas pressure.

19. The fluidics flow control of claim 18, said conduit being formed of a plurality of sections of conduit; and mitred elbows joining said sections of tubular conduit to form said circuitous passage.

20. The fluidics flow control of claim 19, wherein at least three 90 degree mitered elbows join said sections of said conduit.

21. The fluidic flow control of claim 19, with the addition of an air line communicating with said circuitous passage intermediate opposite ends of said passage such that a portion of air flowing into said circuitous passage from said air line flows through a first section of said circuitous passage in a direction opposite to the direction of flow of condensate, and a portion of air from the air line flows toward said outlet to prevent the flow of gas from said outlet opening through said circuitous passage to said inlet opening.

22. The fluidic flow control of claim 18, with the addition of ancillary means for connecting said conduit to the region of low gas pressure, said ancillary means being adapted to deliver a portion of the total volume of gas flowing from the region of higher gas pressure to the region of lower gas pressure.

* * * * *